US005847683A

United States Patent [19]

Wolfe et al.

[11] Patent Number: 5,847,683

[45] Date of Patent: Dec. 8, 1998

[54] TRANSMISSION LINE ANTENNA AND UTILITY METER USING SAME

[75] Inventors: Paul D. Wolfe, deceased, late of Lawrenceville, by Peggy Wolfe, executor; William C. Phelps, III, Lawrenceville, both of Ga.

[73] Assignee: Motorola, Inc., Schaumburg, Ill.

[21] Appl. No.: 739,474

[22] Filed: Oct. 28, 1996

[51] Int. Cl.[6] ..... H01Q 7/00

[52] U.S. Cl. ..... 343/866; 343/741; 343/868

[58] Field of Search ..... 343/866, 867, 343/741, 742, 700 MS, 748, 752, 732, 868; H01Q 7/00

[56] References Cited

U.S. PATENT DOCUMENTS 2,291,450 7/1942 Case ..... 343/867

4,801,944 1/1989 Madnick et al. ..... 343/741

5,726,665 3/1998 Wine ..... 343/741

*Primary Examiner*—Hoanganh Le

*Attorney, Agent, or Firm*—Felipe J. Farley

[57] ABSTRACT

A transmission line antenna (10) comprises first and second ends (14 & 16). Each end has a mounting portion defining a mounting height and an overlapping portion (18 & 20) defining an overlapping width. The overlapping portions are formed by bringing the ends around the ring and past each other, and are electrically connected together. The antenna is interconnected to a circuit board having a circuit impedance, and the mounting height and overlapping width are configured such that the antenna impedance matches the circuit impedance.

12 Claims, 3 Drawing Sheets

42
30
28
18
16
22
20
24
26
14
40

TRANSMISSION LINE ANTENNA AND UTILITY METER USING SAME

TECHNICAL FIELD

The inventions relates in general to antennas, and more particularly to transmission line antennas and associated systems.

BACKGROUND

Transmission line antennas are used in a variety of applications, such as pagers and other communications systems. the low profile characteristics of the transmission line antenna make it ideally suited for products which require a high performance undertrusive antenna. with other antenna systems, the loop antenna is coupled to a circuit through a matching network to reduce signal loss, and is based on the device's circuit impedance and the antenna impedance. For a given device, different matching networks and antenna mounting hardware are required if the device operates in different frequency bands since the circuit impedance and antenna impedance are functions of frequency.

The transmission line antenna is typically constructed of a conducting ring mounted adjacent to an associated ground plane. In products requiring minimal cost and size, the product's circuit board may be utilized as the ground plane for the transmission line antenna. For manufacturers employing this technique, this typically means unique circuit boards for each frequency band. Since each different frequency band requires an unique antenna length, matching networks, associated interconnect points and antenna mounting hardware, the layout of the circuit board is dependent on the frequency band. Each circuit board requires unique tooling, inventory tracking, and assembly routines, among other things. The cost of having several unique circuit boards is substantially higher than for a single circuit board produced in higher quantities.

Therefore, there is a need in an antenna system for a means by which a common layout may be used for circuit boards of devices which operate in different frequency bands. Such means would significantly reduce the cost of producing devices utilizing transmission line antennas.

DETAILED DESCRIPTION OF THE PREFERRED EMBODIMENT

Figure 1:
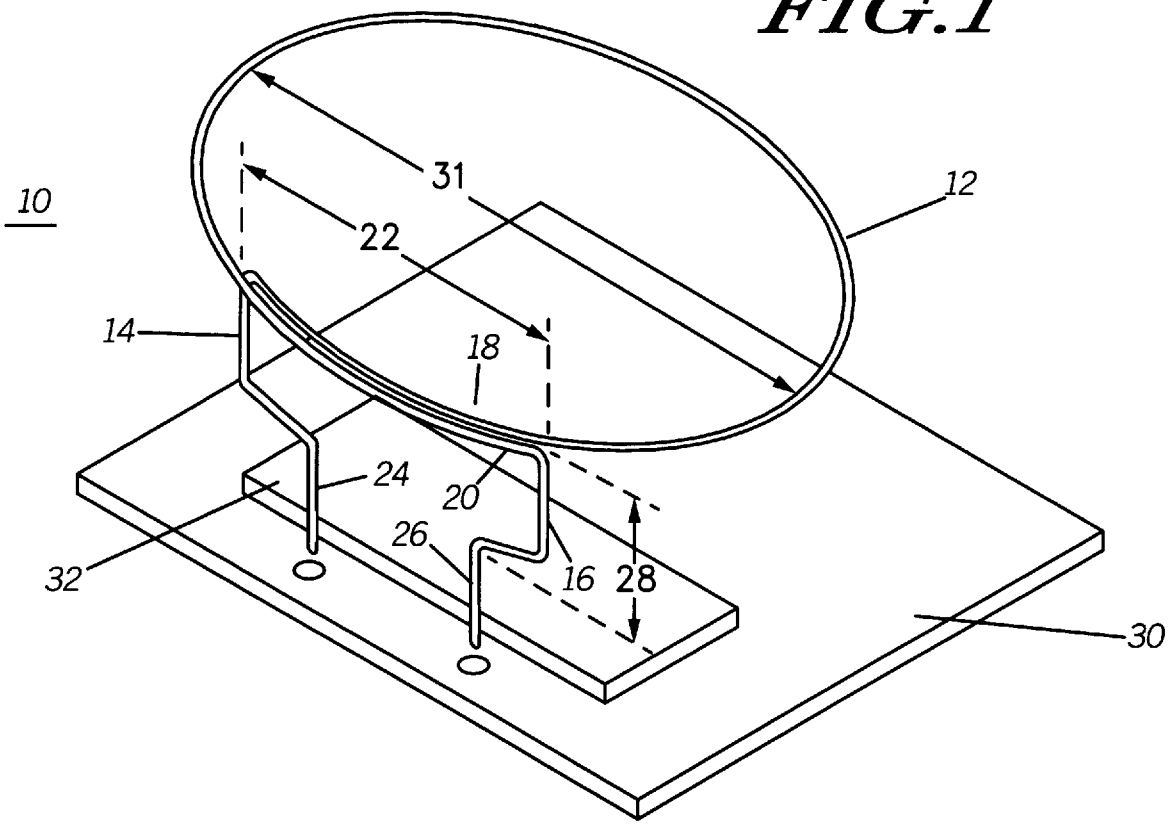
FIG. 1 is a perspective view of a transmission line antenna in accordance with a first embodiment of the invention.

While the specification concludes with claims defining the features of the invention that are regarded as novel, it is believed that the invention will be better understood from a consideration of the following description in conjunction with the drawing figures, in which like reference numerals are carried forward.

Referring now to FIG. 1, there is illustrated therein a perspective view of a transmission line antenna 10 in accordance with a first embodiment of the invention. The antenna comprises a ring of conductor 12 having a first end

14 and a second end 16. Each end has an overlapping portion 18 and 20 respectively, which define an overlapping width 22, and a mounting portion 24 and 26 which define a mounting height 28. The overlapping portions are electrically connected together, and preferably are soldered together along the entire overlap. The ring diameter 31 is selected such that it results in an overall circumference of the ring, less the overlapping portion, that it is equal to approximately one half of a wavelength for a given frequency. The antenna is mounted above a ground plane 30, which in this embodiment is also the product's circuit board. The antenna is interconnected to the circuit board 30 via the mounting portions, and secured by any of a number of conventional techniques, such as soldering.

On the circuit board is a circuit 32 which has a defined circuit impedance. The circuit uses the antenna to transmit or receive, or both, and the circuit impedance is dependent upon the circuit components as well as the physical geometry of the system.

In order to achieve the lowest signal loss, typically a matching network is used between the antenna and the circuit. As is well known in the art, the matching network is typically a passive network that transforms the impedance in both directions so that there is an apparent conjugate match, thereby minimizing signal loss. In the present invention, however, all or a substantial majority of the matching is performed by configuring the first and second end portions, and the overlapping portion of the antenna, thereby allowing a common circuit layout to be used for different frequency bands. The matching is achieved by adjusting the mounting height 28 and the overlapping width 22. In the preferred embodiment, the second end of the loop is electrically connected to some reference, such as a circuit ground. The point at which the first mounting portion 14 connects to the overlapping portions is a tap point. When the antenna is used to transmit a signal, this point is also referred to as a feed point. The distance from the tap point to the second mounting portion determines the impedance looking into the loop 12 from the tap point. The farther along the loop the tap point is, the higher the impedance will be at the tap point. A second variable in the antenna configuration is the mounting height 28. In general, as the mounting height increases, so does the impedance looking into the first end from the circuit board. By correctly selecting these two dimensions, the antenna can be configured so that the antenna impedance, looking into the first end of the ring, matches the circuit impedance.

By configuring the antenna as described above, the circuit board layout can remain the same for different frequency bands. Although a small matching network may be required on the circuit board, it will be minimal, and only small variations in component values will need to change. As such, the layout for these components is the same, and proper matching becomes simply a substitution of components. The majority of matching is done by properly configuring the ring ends. In general, the antenna will appear inductive, and a small valued capacitor may be necessary on the circuit board to achieve an optimal impedance match.

This matching technique also provides additional manufacturing benefits. The overlapping portion of the ring, once soldered, secures the antenna ends at their proper location, fixes the antenna circumference and results in a rigid antenna structure requiring minimal, if any, additional supporting hardware.

Figure 2:
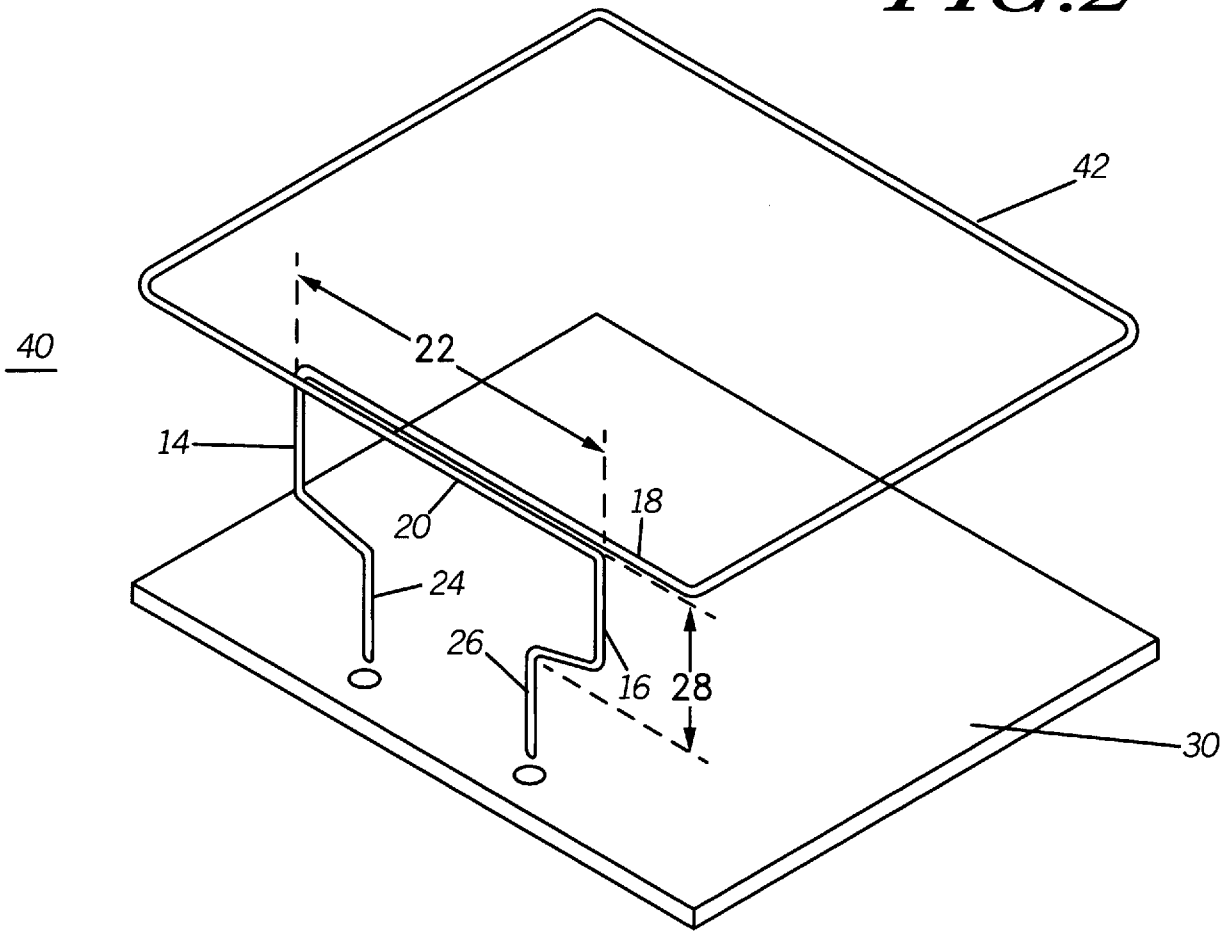
FIG. 2 is a perspective view of a transmission line antenna in accordance with a second embodiment of the invention.

Referring now to FIG. 2, there is illustrated therein a perspective view of a transmission line antenna 40 in accordance with a second embodiment of the invention. In this embodiment, the ring of conductor 42 is formed in a square shape, as opposed to the circularly shaped ring of FIG. 1. Although conventionally the term "ring" has been used to refer to a circularly shaped structure, here a broader definition is used to include any non-circular shape, such as the square "rings". The first and second ends 14 and 16 are configured much as in FIG. 1 so as to allow matching of the antenna impedance with the circuit impedance.

Figure 3:
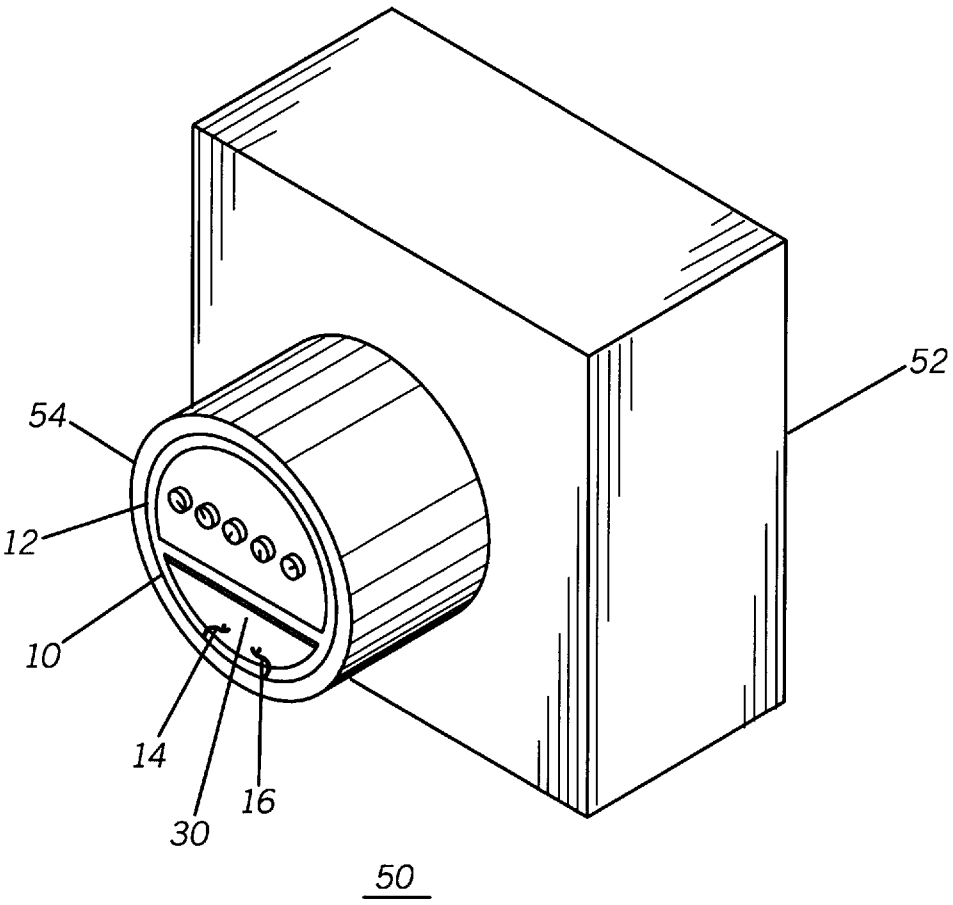
FIG. 3 is a perspective view of a utility meter in accordance with the invention.

Referring now to FIG. 3, there is illustrated therein a perspective view of a utility meter 50 in accordance with the invention. The utility meter comprises a housing 52, and may include a glass cover 54, as is common on electric meters. The meter further comprises the elements of FIG. 1, and in particular circuit board 30, and transmission line antenna 10. From this illustration it can be seen how a transmission line antenna is especially suited to utility meter applications. The conductor ring resides under the glass cover, which is similarly shaped. In other types of meters, such as gas meters, for example, the transmission line antenna of FIG. 2 is preferable over the circular antenna because of the differing product form factors. The antenna and circuit board are thus adapted to, for example, transmit information collected by said utility meter to a remote location. .

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A transmission line antenna for a device having a circuit impedance, comprising:

a ring of conductor having an antenna impedance and first and second ends, each of said ends having a mounting portion defining a mounting height and an overlapping portion defining an overlapping width between the first and second ends; and wherein said mounting height and said overlapping portion are adjusted such that said antenna impedance matches said circuit impedance.

2. A transmission line antenna as defined by claim 1, wherein said overlapping portion of said first end is electrically joined with said overlapping portion of said second end.

3. A transmission line antenna as defined by claim 1, wherein said ring of conductor is substantially circularly shaped.

4. A transmission line antenna as defined by claim 1, wherein said ring of conductor is substantially square shaped.

5. A transmission line antenna as defined by claim 1, wherein said first end of said ring of conductor is a feed point, and said second end of said ring of conductor is electrically connected to a circuit ground.

6. A transmission line antenna as defined by claim 1, wherein said ring of conductor has a circumference, said circumference less said overlapping portion is a half wavelength.

7. A utility meter, comprising:

a circuit board having a circuit having a circuit impedance;

a ring of conductor, mounted on said circuit board, having an antenna impedance and first and second ends, each of said ends having a mounting portion defining a mounting height and an overlapping portion defining an overlapping width between the first and second ends and wherein said mounting height and said overlapping portion are adjusted such that said antenna impedance matches said circuit impedance.

8. A utility meter as defined by claim 7, wherein said overlapping portion of said first end is electrically joined with said overlapping portion of said second end.

9. A utility meter as defined by claim 8, wherein said ring of conductor is substantially circularly shaped.

10. A utility meter as defined by claim 8, wherein said first end of said ring of conductor is a feed point, and said second end of said ring of conductor is a ground point.

11. A utility meter as defined by claim 7, wherein said ring of conductor is substantially square shaped.

12. A utility meter as defined by claim 7, wherein said ring of conductor has a circumference, said circumference less said overlapping portion is a half wavelength.

* * * * *